United States Patent [19]

Day

[11] Patent Number: 4,923,581

[45] Date of Patent: May 8, 1990

[54] TONER RECYCLING BY COUNTERFLOW

[75] Inventor: Gene F. Day, Hillsborough, Calif.

[73] Assignee: Precision Image Corporation, Redwood City, Calif.

[21] Appl. No.: 277,121

[22] Filed: Nov. 28, 1988

Related U.S. Application Data

[63] Continuation-in-part of Ser. No. 77,104, Jul. 23, 1987, now U.S. Pat. No. 4,799,452.

[51] Int. Cl.[5] ..... B03C 5/02

[52] U.S. Cl. ..... 204/180.1; 204/186; 204/299 R; 204/300 R; 204/304; 118/603; 118/645; 209/127.1; 209/130; 355/256

[58] Field of Search ..... 209/127.1, 128–130; 118/603, 645, 647, 659, 660; 204/180.1, 183.1, 183.3, 186, 299 R, 300 R, 302, 304, 299 EC, 300 EC; 355/256, 327; 430/45, 114, 137

[56] References Cited

U.S. PATENT DOCUMENTS

| | | | |
|---|---|---|---|
| Re. 29,818 | 10/1978 | Gerbasi et al. | 118/652 |
| 3,129,115 | 4/1964 | Clark et al. | 118/637 |
| 3,249,225 | 5/1966 | Stuetzer et al. | 209/129 |
| 3,589,991 | 6/1971 | Hardy | 204/180.1 |
| 3,642,605 | 2/1972 | Chenel et al. | 204/300 R |
| 3,790,466 | 2/1974 | Akiyama | 204/300 |
| 3,799,340 | 3/1974 | Tamai et al. | 209/127.1 |
| 3,870,644 | 3/1975 | Machida et al. | 430/45 X |
| 3,962,069 | 6/1976 | Inoue et al. | 204/300 R |
| 4,090,937 | 5/1978 | Stoev et al. | 204/300 R X |
| 4,267,245 | 5/1981 | Wada | 430/97 |
| 4,449,475 | 5/1984 | Schinke | 118/645 |
| 4,706,605 | 11/1987 | Bibl et al. | 118/631 |
| 4,799,452 | 1/1989 | Day | 209/130 X |

FOREIGN PATENT DOCUMENTS

| | | | |
|---|---|---|---|
| 54-143131 | 11/1979 | Japan | 430/114 |

*Primary Examiner*—Russell D. Stormer
*Assistant Examiner*—Edward M. Wacyra
*Attorney, Agent, or Firm*—Thomas Schneck

[57] ABSTRACT

A system and method for recovering charge-bearing solid pigment particles from a fluid dispersant in a liquid toner, wherein the system includes a particle-accumulating surface spaced apart from a complementary electrically biased electrode surface to define a channel therebetween. The channel has a mouth in gravity-feed relation to an outlet. Liquid toner is introduced at the mouth to cause flow within the channel. The bias of the electrode, however, sets up an electric field in the channel directing charge-bearing solid pigment particles away from the electrode surface so that only substantially particle-free fluid dispersant reaches the outlet. A slime rich in charge-bearing solid pigment particles collects on the particle-accumulation surface which is moved in a direction opposite of toner flow. At a location remote from the electrode, the solid pigment particles are removed from the particle-accumulating surface and are stored for later remixing with the fluid dispersant to form fresh toner.

17 Claims, 2 Drawing Sheets

TONER RECYCLING BY COUNTERFLOW

CROSS-REFERENCE TO RELATED APPLICATION

The present application is a continuation-in-part application of U.S. application Ser. No. 077,104, filed July 23, 1987, now U.S. Pat. No. 4,799,452.

TECHNICAL FIELD

The present invention relates to electrographic printing and in particular to systems and methods of dispensing, circulating, using and reusing liquid toners in electrographic printers and electrophotographic copiers and printers.

BACKGROUND ART

In electrographic printing and copying, toner compositions are applied to an electrostatic latent image formed on a dielectric surface in order to develop the image. The dielectric surface may be a coating on a sheet or a web of paper to which the toner is applied. Alternatively, the dielectric surface may be the charge retentive surface of a drum, belt or the like from which toner applied thereto is transferred to a sheet or web of plain paper. The electrostatic latent image may be established through electrostatic induction by a charged writing head, by ion projection, or through photoconduction, as in electrophotographic copiers. Typically, the toner composition is a liquid toner composed of pigments or dyestuffs combined with a plastic or resinous binder, hereafter called "solid pigment particles" or "colorant", with very small amounts of added charged control agents, and dispersed in a large volume of liquid dispersant, primarily composed of a solvent. One common solvent used in liquid toners is an isoparaffinic hydrocarbon available under the trademark Isopar from the Exxon Corporation.

Multi-color electrostatic printers typically store liquid toner in supply tanks, one for each desired color, and selectively dispense the toner to one or more applicators as it is needed. Usually any excess toner is returned to the appropriate supply tank for reuse. Because pigment particles are deposited in the printing process upon the latent image, the excess toner returned to the supply tanks quickly dilutes the supply of toner until it becomes so dilute that it must be replenished. A concentrated form of colorant is periodically added to the supply tank to restore the colorant removed by the toning process. Liquid toners have a very delicate chemical balance which is easily upset by aging, excess replenishment, contamination, color intermixing, selective constituent removal during electrophoretic toning, or heavy use. If the chemical balance is lost, poor imaging results and the entire content of the tank or tanks must be replaced.

Poor quality, resulting from a chemical imbalance, is manifest on an image by smearing, streaking, background staining, and loss of color concentration or various combinations thereof. Thus, despite many advantages that liquid toning has over other marking methods, it is necessary to periodically dispose of large volumes of combustible liquid. It is difficult, at best, to dispose of such liquid without posing a risk to the environment.

In prior application Ser. No. 077,104, now U.S. Pat. No. 4,799,452, assigned to the assignee of the present application, a liquid toner recycling system was disclosed for removing the solid pigment particles from fluid dispersant after completion of developing a latent image. The liquid toner is introduced at one end of a region defined between an electrode and a particle-accumulating surface, and the liquid toner is carried through that region. The electrode is biased to repel the solid pigment particles so that the particles are deposited on the particle-accumulating surface. Substantially particle-free fluid dispersant remains and is removed at the exit of the region, while the solid pigment particles continue to travel with the particle-accumulating surface to an area at which the particles are scraped from the surface. The substantially particle-free fluid dispersant is then returned to a supply tank. Likewise, the solid pigment particles, now in a state referred to in the art as concentrate, are returned to the appropriate supply tank. Thus, in a multi-color printer a single supply tank of fluid dispersant may be used, with small volumes of color concentrate being added to the fluid dispersant as desired. For example, a two to four ounce supply tank of concentrate may be used for each color in place of the previously used two gallon tank.

While the above-described system meets the object of liquid toner recycling for permitting use of one tank of fluid dispersant with a number of color concentrates, it has been discovered that further improvement in removing solid pigment particles from color dispersant is possible. In addition, it has been discovered that sparking between the electrode and the particle accumulation surface can be substantially eliminated by arranging the system so that toner or carrier fluid always fills the entire space between the electrode and the accumulation surface. Furthermore, it has been discovered that there sometimes are difficulties in redispersing the rather thick agglomerate to make new toner.

It is an object of the present invention to provide a liquid toner recycling system and method which improves upon the elimination of solid pigment particles from fluid dispersant. A further object of the present invention is to provide a liquid toner recycling system with integral redispersion of the separate particles. Yet another object of the present invention is to provide a liquid toner recycling system with an electrode which does not spark relative to nearby structures.

DISCLOSURE OF THE INVENTION

The above objects have been met with a liquid toner recycling system in which solid pigment particles are separated from fluid dispersant by electrostatic force causing adherence to a particle-accumulation surface moving in a direction opposed to the flow of fluid dispersant. The particle-accumulating surface of the liquid toner recycling system is spaced apart from a particle repelling electrode having a surface shaped so that a wide area electrostatic field can be formed adjacent to the accumulating surface, defining a channel therebetween. The channel has a mouth and has an outlet that is downstream of the mouth. The electrode surface is electrically biased relative to the particle accumulation surface to propel solid pigment particles toward the accumulation surface. Typically, the particles are positively charged, and in this case the electrode is also biased positively. The solid pigment particles repelled from the electrode form a slime of particles adjacent to the particle-accumulation surface. The slime is characterized by a thick viscosity which efficiently captures particles on the particle-accumulation surface. Thus, the solid pigment particles are collected on the particle-accumulating surface.

The particle-accumulating surface is typically an endless loop, and is preferably the surface of a rotating drum, but could be a belt. The direction of movement is from the outlet towards the mouth of the channel. That is, relative to fluid dispersant flow through the channel, the particle-accumulating surface is provided with upstream motion. Liquid toner is supplied at the mouth and particles are deposited onto the moving particle-accumulating surface in a counterflow and are transported from the channel. The solid pigment particles are then removed from the particle-accumulating surface and stored in a reservoir for later recombination with the fluid dispersant.

The solids separation method is carried out by introducing liquid toner at the mouth of the channel formed between the electrode surface and the particle-accumulating surface. The particle-accumulating surface is moved relative to the electrode surface. The electrically biased electrode repels the solid pigment particles so as to leave a stream of substantially particle-free fluid dispersant flowing adjacent to the electrode and a slime containing solid pigment particles on the particle-accumulating surface which is then transported to a reservoir for storing concentrate.

An advantage of the present invention is that the upstream motion of the particle-accumulating surface provides a counterflow against downwardly injected toner, offering an increased opportunity for charged particle capture. The differential velocities may be adjusted for maximizing separation efficiency. This provides a significant improvement over solid pigment particle separators in which the particles are collected on an accumulation surface while being static relative to or in corresponding motion with the separated fluid dispersant. With corresponding motion, the slime must be separated from the clear dispersant proximate to an outlet and any loose or poorly adhered particles may break from the accumulation surface and contaminate the dispersant stream.

The liquid toner recycling system employs a spinning "paddlewheel" to scrape the agglomerated solids from the particle accumulating surface. The rapid motion of this spinning paddlewheel provides strong agitation and enhanced fluid shear so as to insure homogeneous mixing of the agglomerate with the clear fluid which is carried along with the agglomerate by the motion of the accumulating surface. This strong mixing action produces a concentrate of relatively thin consistency which is very easily diluted to make fresh toner.

The problem of sparking from the electrode to the accumulating surface is addressed by an elevated portion in the clear fluid return line from the separator to the dispersant tank. In the same manner as a trap under an ordinary sink, this elevated portion ensures that toner or carrier fluid always fills the entire space between the high-voltage electrode and the accumulating surface. Since the carrier fluid is a good electrical insulator this acts to prevent sparking which would otherwise occur. Such sparking may cause a reduction in applied electrical bias and could result in incomplete separation of the solids from the clear fluid which is returned to the dispersant tank. Furthermore, if any such sparking were to occur with the system at an elevated temperature, actual ignition of the combustible fluid might occur.

BEST MODE FOR CARRYING OUT THE INVENTION

Figure 1:
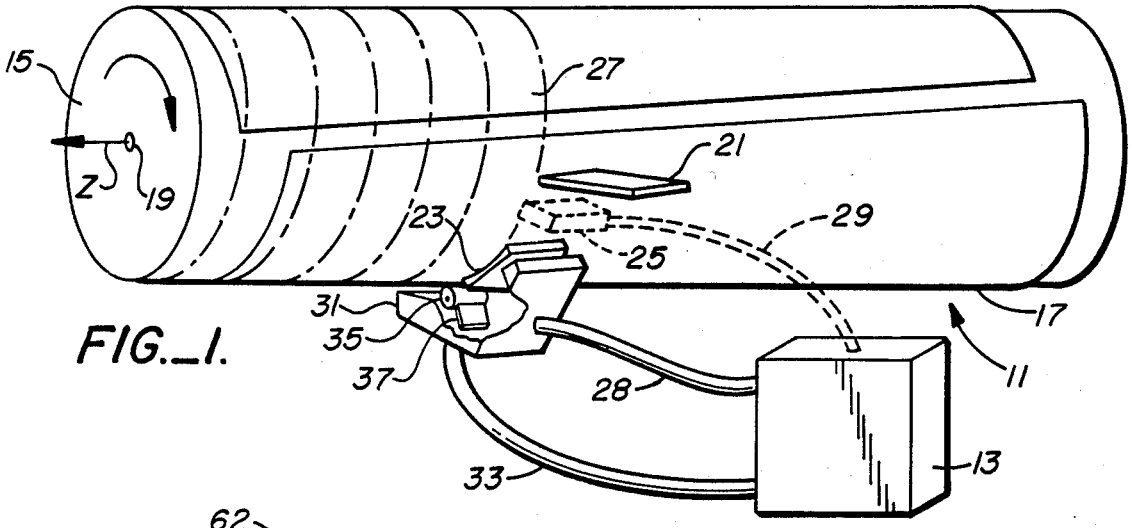
FIG. 1 is a perspective view of an electrostatic printer employing the toner recycling system of the present invention.
Figure 2:
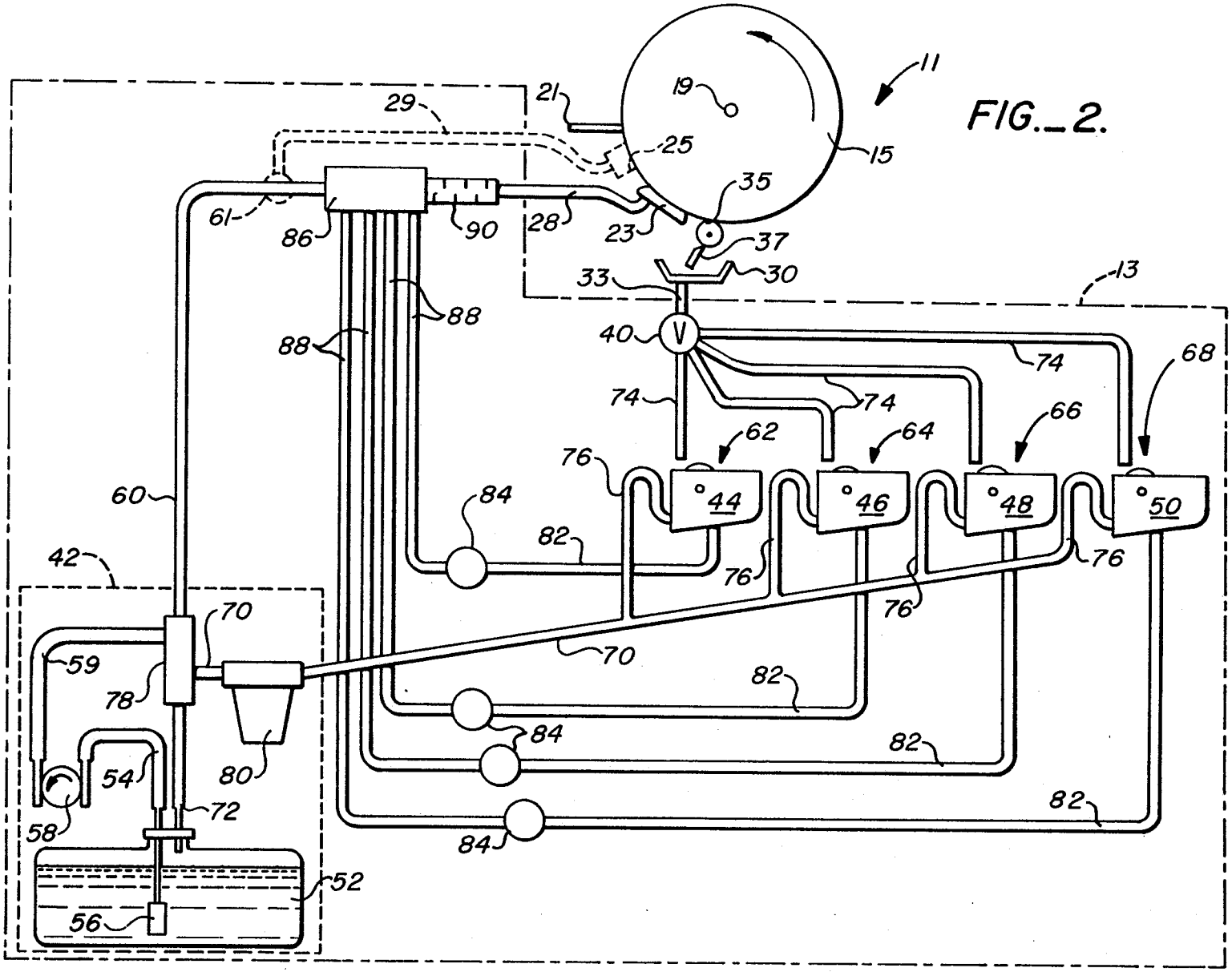
FIG. 2 is a schematic view of the toner recycling system of the present invention including solid separators carrying out a method of the present invention for separating pigment particles from toner.

With reference to FIGS. 1 and 2, an electrostatic printer 11 is shown employing a toner recycling system 13. In the electrostatic printer 11, a drum 15 supports a sheet of paper 17 for rotation. An axle 19 located on the longitudinal axis Z through the center of the drum 15 supports the drum and transmits rotational energy from a motor, not shown. The size of the drum 15 may vary, a large size drum typically having a diameter of approximately twelve inches and a width of approximately fifty two inches. The sheet of paper 17 is coated with a charged-retaining dielectric medium on which a latent image may be formed and developed. Alternatively, a latent image may be formed and developed directly on a drum, with the developing image later transferred onto a sheet of plain paper.

An electrostatic head 21 for creating an electrostatic latent image is in mechanical contact with the sheet 17, applying charge thereto. The head 21 may comprise a linear array of wires forming charging elements, the forward edge of which is in very close proximity to the sheet of paper 17. The electrostatic head 21 is typically only a fraction of the width of the sheet and is translated laterally, parallel to the longitudinal axis Z of the drum 15 so that a helical stripe pattern 27, indicated by the dashed lines, is traced on the sheet. Alternatively, the head 21 may be a full-width head which is fixed in position. The number of wires in the head may range from 100 to 20,000. The charging elements are at a negative potential of 400 to 600 volts relative to a drum at ground or at a positive potential. Polarities may be reversed.

A toner applicator 23 follows the electrostatic head 21 and applies liquid toner for developing a latent image existing in the charge pattern deposited on the sheet of electrostatic paper 17. The latent image created by the head 21 is thus formed into a visible image. The toner applicator 23 may be a toning shoe, as shown, which supplies the liquid toner locally to the sheet of paper along the helical stripe pattern 27, or may alternatively be a full drum width toning fountain or pool applicator. A prewet station 25 located between the head 21 and the applicator 23 may be included to wet the latent image prior to toning. The wetting of the prewet station 25 is provided by a clear fluid dispersant, such as the hydrocarbon sold under the trade name Isopar by Exxon Corporation. The prewetting can enhance toning contrast by greatly reducing background marking.

Liquid toner is applied to the toner applicator 23 from the toner recycling system 13 through an inlet 28. Likewise, if desired, clear dispersant may be supplied to the prewet station 25 from the toner recycling system through a second inlet 29. Excess toner falls into a catch basin 30 at the bottom of a hood 31 for collection and return through a drain pipe 33 to the toner recycling system 13. A drying roller 35, also carried within the hood 31, contacts the drum 15 for removing excess liquid toner. Once the excess liquid toner is removed, it is scraped from the drying roller 35 by a blade 37.

The toner recycling system 13 may include a single solids separator for separating pigment particles from the fluid dispersant component of the liquid toner. Such a separator is capable of handling each color of liquid toner successively. Alternatively, the toner recycling system 13 may include a plurality of separate solids separators dedicated to each of the colors of the liquid toner, as shown in FIG. 2. In the latter case, a selector valve 40 may be used to direct a particular color of excess liquid toner to the appropriate solids separator. An alternative embodiment is to use separate toner applicators 23 and catch basins 33 for each color.

The toner recycling system 13 shown in FIG. 2 for use with electrostatic printers 11 and the like is shown to include a fluid dispersant supply subsystem 42 and a plurality of supply tanks 44, 46, 48 and 50 of color concentrate. The fluid dispersant is stored within a supply container 52 of the fluid dispersant supply subsystem 42. The fluid dispersant is primarily composed of a narrow cut isoparaffinic petroleum solvent consisting of predominantly of C10 and C11 isoparaffinic hydrocarbons. Other solvents may also be used. The color concentrates contain charge-bearing solid pigment particles, typically composed of pigment or dyestuffs coated or mixed with a plastic or resinous binder. Either or both of the fluid dispersant or the color concentrates may contain a small amount of charge control agent. Preferably, the fluid dispersant and the liquid phase of the concentrates all contain the same concentration of charge control agent.

Fluid dispersant is pumped from the supply tank 52 through an outlet 54 extending into the supply tank and terminating in a particle filter 56. The particle filter 56 is optional. Pumping is performed by a pump 58 which causes dispersant to be drawn up the outlet 54 and sent along a feedline 60 through the inlet 28 of the toner applicator 23. The second inlet 29 to the optional prewet station 25 branches off of the feedline 60 at a valve 61. Excess liquid toner or dispersant is collected by the catch basin 30 which communicates via the drain tube 33 with the solids separators 62, 64, 66 and 68. After any solid pigment particles have been separated, the fluid dispersant returns to the supply tank 52 via a return line 70 and a tank inlet 72. Toner introduction lines 74 channel liquid toner from the selector valve 40 to the individual solids separators 62–68, while dispersant drain lines 76 channel the fluid dispersant back to the return line 70 after removal of the solid pigment particles from the liquid toner. An aspirator 78 between the feedline 60 and the return line 70 provides pressure to the feedline 60 and suction to the return line 70 to aid circulation. A filter 80 may be placed along the return line 70 to filter out any remaining particles from the dispersant. By means of the pump 58 and associated lines, a stream of liquid dispersant is continuously circulated from the supply tank 52 to a toner fluid applicator 23 and back to the supply tank. Alternatively, the aspirator may be omitted and the return line 70 fed directly to the dispersant tank 52. In this case, filter 80 would be inserted into supply line 60.

A set of concentrate feedlines 82 lead from the concentrate tanks 44–50 through injector pumps 84 to an injection body or manifold 86 in the path of the circulating fluid dispersant. The injectors 84 selectively inject an amount of color concentrate into the stream of fluid dispersant by means of an individual valve opening or pump actuation. The amount of concentrate injected into the stream of fluid dispersant may be controlled by varying the degree of valve opening or pump actuation. Typically, the concentrate has a solids content in the range of 10 to 40% by weight. From the injector lines 88 concentrate is channeled into the manifold 86, whereafter a mixer 90 mixes the color concentrate with the continued flow of fluid dispersant, causing pigment particles to disperse in the fluid to form liquid toner. A typical mixer operates by providing a tortuous path for the stream of fluid dispersant with injected color concentrate. The resulting liquid toner is applied to a latent image by the applicator 23 which is part of an electrostatic printer 11 or the like.

Figure 3:
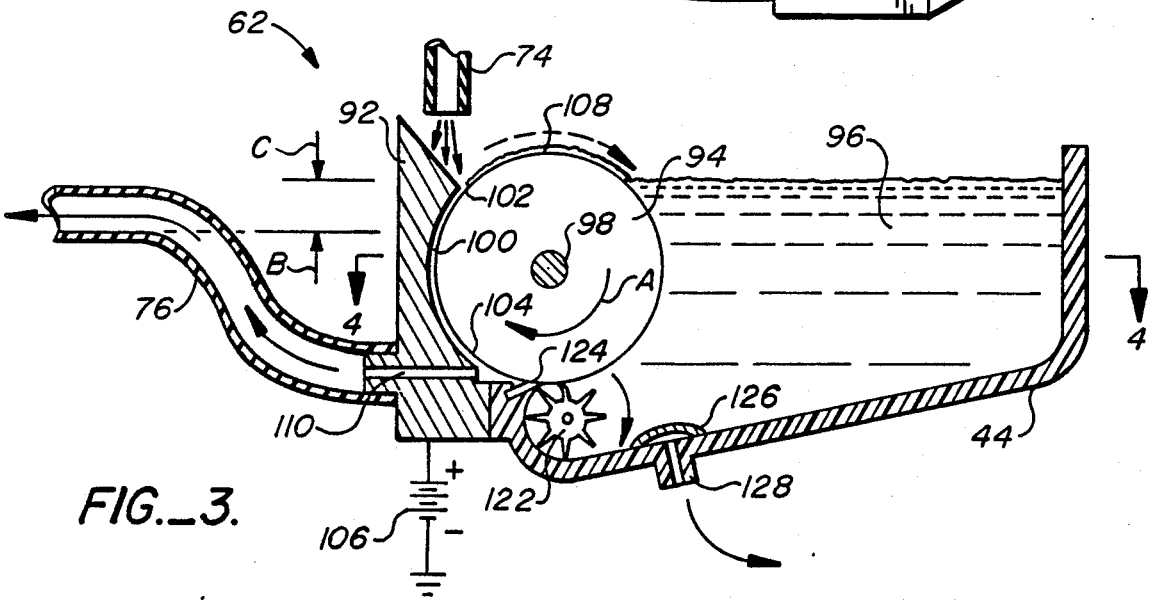
FIG. 3 is an expanded side sectional view of a solid separator of FIG. 2.
Figure 4:
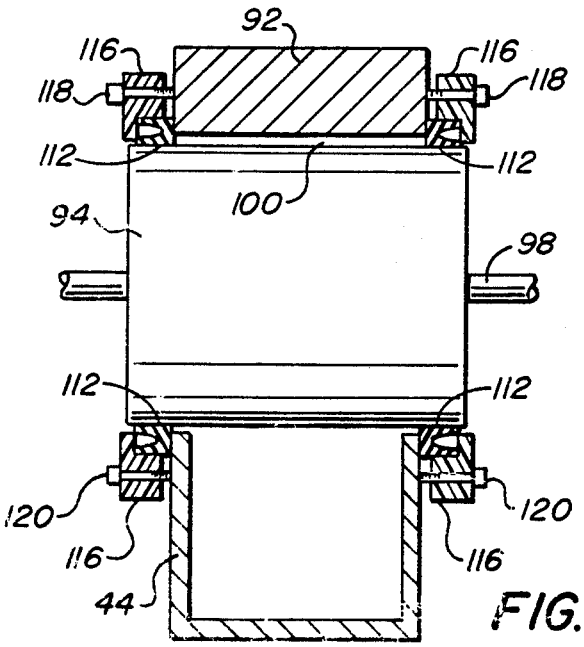
FIG. 4 is a top diagrammatic cross sectional view of the solid separator of FIG. 3 taken along lines 4—4.

Referring now to FIGS. 3 and 4, a solids separator 62 includes an electrode 92, a particle-accumulating surface, here the surface of a drum 94, and a supply tank 44 holding a reservoir 96 of concentrate. The particle-accumulating surface of the drum 94 rotates about an axle 98 in the direction indicated by arrow A. Electrode 92 should have a width equal to that of the drum 94 and a complementary surface. Complementary surfaces, generally uniformly spaced, will have a predictable electric field therebetween when a potential difference is applied between surfaces. Since drum 94 presents a convex outer surface, the ideal electrode surface is concave, with equal curvature. The extent of wrap of the electrode about the drum surface should be more than 30°, thereby providing a wide area for electrostatic removal of particles. The electrode 92 and the drum 94 are closely spaced, typically about 30 mils (762 microns) apart, and define a flow channel 100 therebetween. The mouth 102 is at the upper extent of the channel 100 opposite an outlet end 104. Excess liquid toner is received at the mouth 102 from the toner introduction line 74.

Liquid toner introduced at the mouth 102 of the drainage spacing 100 will tend to enter the channel by force of gravity. However, the electrode 92 is electrically biased by a power supply 106 so as to repel solid pigment particles and drive the particles toward the particle-accumulating surface of the drum 94. Typically, the electrode 92 has an electrical potential of between two and four kilovolts relative to the drum. As will be explained more fully below, pigment particles deposit and agglomerate on the surface of the drum to form a layer 108 of color concentrate that is carried by the motion of the drum to the reservoir 96 of concentrate.

The charge-bearing solid pigment particles within the liquid toner that is introduced at the mouth 102 of the channel 100 are typically positively charged. The pigment particles are repelled by the electrode 92 upon entrance into the channel 100. As the pigment particles progress along the length of the channel, the pigment particles are moved increasingly closer to the drum 94. In this manner, a concentration of pigment particles develops adjacent to the drum. The concentration of pigment particles is characterized by a viscosity which causes the particulate mass to follow the rotation of the drum 94. Because of the narrow spacing of the channel 100, fluid flow within the channel resembles laminar flow. The attraction of the pigment particles to the drum 94 and the friction of the drum against the layer of concentration immediately adjacent the drum cause the first layer to follow the rotation of the drum. The highly viscous concentration prevents neighboring layers of the fluid from sliding freely past one another. The length of the channel 100 and the potential difference created by the power supply 106 are such that pigment particles travel a maximum of approximately 75% of the length of the channel. However, the pigment particles are plated out of the flow of fluid through the channel prior to reaching the outlet 104. The drum is rotated in a direction opposite of the flow of fluid dispersant, carrying the pigment particles back to the mouth 102 so that the pigment particles do not reach the outlet 104.

As the charge-bearing solid pigment particles are plated out from the flow of fluid through the channel 100, in the form of a particle-rich slime, the flow to the outlet 104 becomes increasingly free of particles. Eventually, particle-free fluid dispersant is received at the outlet 104. A continuous flow of liquid toner at the mouth 102 causes the particle-free dispersant at the outlet to be forced through a passageway 110 in the electrode 92 for removal from the drain line 76. The particle-free dispersant is then returned to the supply tank of fluid dispersant.

Because the electrode 92 has a high electrical potential relative to the drum 94, it is important that there are few or preferably no air gaps within the channel 100. Any gaps within the flow through this spacing may result in sparking from the electrode 92 to the grounded accumulator drum 94. Sparking may cause a reduction in applied electrical bias and could result in incomplete separation of the solids from the fluid dispersant. Moreover, if sparking were to occur with the system at an elevated temperature, ignition of the combustible fluid might occur.

To reduce the risk of sparking, the dispersant drain line 76 is shaped as shown in FIG. 3. Prior to introduction of liquid toner to the mouth 102 of the channel 100, fluid dispersant within the solids separator 62 has a static fluid level along a plane indicated by arrow B and defined by the highest extent of the bottom of the drain line 76. Until a pressure head is formed above the plane indicated by arrow B, no flow will take place through the dispersant drain line 76. Initially, particle-free fluid dispersant is introduced at the mouth 102. Then, after a pressure head has been formed having a level at least reaching the plane indicated by arrow C the power supply 106 may be activated and solid pigment particles may be added to the flow from introduction line 74. The risk of sparking is further reduced by rounding the corners of the electrode at the mouth 102 and outlet 104.

Figure 5:
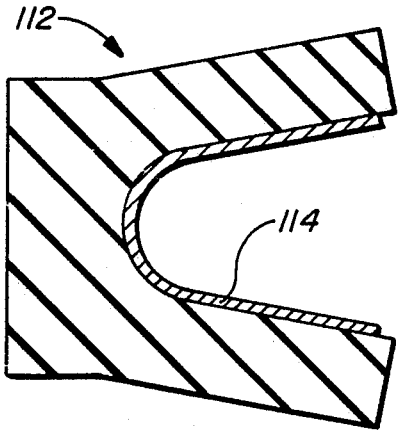
FIG. 5 is a top sectional view of a seal for use with the solid separator of FIG. 4.

Because of the high voltage across the drainage spacing, the end seals 112 shown in FIGS. 4 and 5 are important. Use of a rubber end seal may result in formation of a carbon trail should sparking take place within the channel 100. A carbon trail across the face of the end seal between the high voltage electrode 92 and the grounded accumulation drum 94 would cause a breakdown and prevent the high voltage from being sustained between the components. Polytetrafluoroethylene is the preferred material in forming the end seal 112. Such a material resists the problem described above, is extremely stable, and is self lubricating. However, because of the tendency of polytetrafluoroethylene to flow under high stress, a steel spreader spring 114 is required to maintain the geometry of an end seal 112. The end seals 112 are ring members which prevent fluid flow from reaching the ends of the accumulator drum 94. Retaining rings 116 which are fastened to the supply tank 44 and the electrode 92 by screws 118 and 120 positionally maintain the end seals.

Returning to FIG. 3, the layer of charge-bearing solid pigment particles 108 on the particle-accumulating surface of the drum 94 is moved by the reverse rotation of the drum into the reservoir 96 of concentrate. This creates a particle slime counterflow relative to incoming toner. The drum velocity and therefore the particle slime velocity may be balanced against the toner flow velocity so that the differential velocity is balanced for adequate and efficient particle removal.

Some of the solid pigment particles break from the layer of particles after entrance into the reservoir, but most of the particles must be scraped from the drum 94. A rotary wiper 122 has eight radially extending blades which sequentially contact the periphery of the drum. Typically, an accumulation drum 94 is two inches wide and makes ten revolutions per minute. The rotary wiper 122 makes 1,000 revolutions per minute so that there are slightly more than 133 scrapings of the drum per second. The rotary wiper also scrapes a polyurethane, peripherally-extending blade 124 which precludes fluid communication between the reservoir 96 and the passageway 110 through the electrode 92.

The rotary wiper 122 scrapes the particle slime from the accumulation drum 94. The rotary wiper provides an enhanced shear relative to a system in which a blade, such as the polyurethane blade 124, is solely responsible for removing particles from an accumulation surface. Perhaps more importantly, the "paddlewheel" wiper 122 creates a strong agitation within the reservoir 96. The agitation insures a homogeneous mixing of the pigment particles with the fluid dispersant that is carried with the pigment particles into the reservoir 96. The strong mixing action produces a concentrate within the reservoir which has a relatively thin consistency which can then be easily diluted in a later remixing with particle-free dispersant to again produce liquid toner.

The supply tank 44 is a plastic member for storing four ounces of concentrate. When desired, the concentrate is combined with particle-free fluid dispersant by valved release of concentrate through the screen 126 and into the concentrate feedline 82 shown in FIG. 2. The screen 126 prevents entrance of agglomerates of solid pigment particles into the concentrate feedline. Agglomerates can clog the fitting 128, shown in FIG. 3, and can adversely affect copy quality in the development of a latent image.

In operation, the electrostatic printer 11 shown in FIG. 2 is initialized and fluid dispersant from the supply tank 52 is caused to flow into an outlet line 54 and into feedlines 59 and 60 by a pump 58. From the feedline 60 particle-free fluid dispersant is channeled to the toner applicator 23 and to the optional prewet station 25. The particle-free fluid dispersant then drains to the catch basin 30 and is channeled to one of the four solids separators 62–68. The tanks 44–50 of the solids separators are dedicated to different concentrates. For example, tanks 44–50 may contain yellow, magenta, cyan and black concentrate respectively.

The solids separators are identical in operation so that explanation can be limited to the solids separator 62 shown in FIG. 3. As the still particle-free fluid dispersant is introduced at the mouth 102 of the channel 100, a pressure head is formed as the fluid level rises from the plane indicated by arrow B to the plane indicated by arrow C. It is only at this time that the power supply 106 is activated and concentrate from the reservoir 96 is released for mixing with the particle-free fluid dispersant. The mixture of concentrate and fluid dispersant is referred to as liquid toner, and is used to develop a latent image. Excess liquid toner is returned to the solids separator 62 by the toner introduction line 74. The liquid toner gravitationally flows into the channel 100, wherein the electrode 92 repels the charge-bearing solid pigment particles from the liquid toner. The solid pigment particles, therefore, begin to accumulate nearer and nearer to the drum 94. The accumulation drum, rotating in a direction opposite the fluid flow, causes the increasingly viscous concentration of solid pigment particles to reverse direction. As the solid pigment particles are plated out from the flow through the channel 100, a once again particle-free stream of fluid dispersant reaches the outlet 104. The particle-free fluid dispersant is channeled through the drain line 76 for return to the supply tank 52.

Typically, the mass 108 of material that is carried by the motion of the drum to the reservoir 96 consists 10–40% pigment particles, the balance comprising clear dispersant. The mass 108 is non-uniform in composition with the greatest concentration of solids nearest the drum and the outermost layers comprising relatively clear dispersant. Depending on the rotational speed of the particle accumulating drum, a greater or lesser amount of clear dispersant is carried along with the particle slime to the concentrate tank 96. By increasing the rotational speed, more clear fluid is carried to tank 96 for mixing with the relatively viscous slime of particles. The amount of clear fluid carried along with the particles varies roughly as the three halves power of the drum speed. A doubling of the drum rotational speed increases the clear fluid carried by about a factor of three. The paddlewheel 122 acts like a small blender to mix, redisperse, and make uniform the particle distribution in the concentrate tank. Controlling the drum speed provides a convenient way to adjust the incoming mass 108 to a desired average composition, thus providing control over the solids fraction in tank 96.

Operation of the injector pumps 84 of FIG. 2 dictates the selection of the various solids separators 62–68 using selector valve 40. While one toner applicator 23 has been shown in development of a latent image regardless of color, it is possible to use a number of different toner applicators. Conversely, it is possible to use one solids separator for the various colors, provided that the solids separator is flushed clean prior to the changing of colors. The system of the present invention, whether containing one common solids separator or several dedicated solids separators, allows toners to be recycled without diluting the concentration of the applied toner. As a result, the latent image to be developed is consistently toned. The concentration of particles added to the dispersant can be easily controlled for better contrast or color balance. Further, there is no need to dispose of diluted toner, since color concentrate and fluid dispersant need only be replaced as they are used up.

I claim:

1. A system for separating charge-bearing particles from fluid dispersant of a liquid toner, said system comprising, a particle-accumulating surface, means for moving said particle-accumulating surface in a first direction, an electrode having a surface spaced from said particle-accumulating surface to define a channel therebetween, biasing means in communication with said electrode for creating an electric field between said surfaces and within said channel, means for supplying liquid toner into said channel such that said liquid toner has a tendency to flow in a second direction opposite said first direction, charge-bearing particles of said liquid toner within said channel moving in said electric field to form a concentration of particles proximate to said particle-accumulating surface, said concentration of particles adhering to said moving particle-accumulating surface to provide a particle rich slime moving in said first direction, thereby leaving a substantially particle-free flow of fluid dispersant in said second direction, means for removing said slime from said particle-accumulating surface at a location remote from said electrode and, a reservoir of charge-bearing particles in containment association with the means for removing and in contact with the particle-accumulating surface, whereby the reservoir is in fluid isolation from the channel.

2. The system of claim 1 wherein said particle-accumulating surface is a surface of a rotatably mounted drum and said channel has a mouth inlet in gravity-feed relation to an outlet.

3. The system of claim 1 wherein said electrode surface is complementary in shape to said particle accumulating surface.

4. The system of claim 1 wherein said means for removing said charge-bearing particles from said particle-accumulating surface is a rotary wiper having a plurality of radially extending blades disposed to serially contact said particle-accumulating surface during rotation of said wiper.

5. The system of claim 1 wherein said channel has first and second opposed lateral ends defined by seals, said seals being in frictional contact with said particle-accumulating surface to prevent fluid flow therebetween.

6. A system for removing charge-bearing solid pigment particles from a fluid dispersant in a liquid toner comprising, an accumulation surface, an electrode having a surface facing said accumulation surface in spaced apart relation thereto forming a channel therebetween, said accumulation surface and electrode being positioned relative to each other to define a mouth and an outlet such that fluid tends to flow in a first direction from said mouth to said outlet, said mouth being positioned at a level above the outlet so that the mouth is in gravity feed relation to the outlet, the outlet being in fluid communication with a fluid dispersant drain line which defines a flow path from the outlet to a trap level above the outlet, means for introducing said liquid toner at said mouth, means for applying an electric potential between said electrode surface and said accumulation surface to cause the charge-bearing pigment particles to move in an electric field established by the potential in a direction whereby said pigment particles collect on said accumulation surface, means for moving said accumulation surface relative to the electrode surface in a direction opposite the first direction thereby separating the pigment particles collecting thereon from liquid toner entering into said channel, and means for removing said pigment particles from the accumulation surface.

7. The system of claim 6 wherein said accumulation surface is an endless loop.

8. The system of claim 6 wherein said accumulation surface is the surface of a drum.

9. The system of claim 8 wherein said electrode surface is arcuate having a curvature such that said channel is a uniform gap between said electrode and said accumulation surface.

10. The system of claim 9 wherein said electrode surface has an angular extent of at least 30°.

11. The system of claim 6 wherein said means for removing said pigment particles from said accumulating surface is a rotary wiper having a plurality of radially extending blades.

12. The system of claim 6 wherein said trap level of the flow path is below the level of said mouth.

13. A method of separating charge-bearing solid pigment particles from a liquid toner comprising, introducing and maintaining a flow of liquid toner from an upstream end and toward a downstream end of a channel formed between an electrode and a particle-accumulating surface, said liquid toner having charge-bearing solid pigment particles dispersed in a fluid dispersant, moving said particle-accumulating surface past said electrode at a selected velocity in an upstream direction opposed to said flow of liquid toner, electrically biasing said electrode to repel said pigment particles so as to leave a stream of substantially particle-free fluid dispersant flowing through said channel adjacent to said electrode, said pigment particles thereby forming a pigment particle rich slime proximate to said particle-accumulating surface, said velocity selected to cause said slime to collect on said particle-accumulating surface moving upstream relative to said dispersant flow, thereby leaving substantially particle-free fluid dispersant at the downstream end of said channel, removing said substantially particle-free fluid dispersant from said downstream end, and removing said pigment particle-containing slime from said particle-accumulating surface after said movement past said electrode, said removing of said pigment particles being performed within a storage tank for said pigment particles.

14. The method of claim 13 wherein said removing of said pigment particles is performed by washing said particle accumulating surface with a rotary wiper having a plurality of radially extending blades.

15. The method of claim 13 wherein said removing of said particle-free fluid is accomplished by a dispersant fluid drain line in which a prescribed fluid level is maintained above said downstream end.

16. A system for removing charge-bearing solid pigment particles from a fluid dispersant in a liquid toner, the system comprising, a rotatable drum having a particle-accumulating surface, means for rotating the drum in a first direction, an electrode having a surface spaced apart from the particle-accumulating surface to define opposed sides of a channel therebetween, the electrode and drum positioned to define a mouth and an outlet to the channel, sealing members forming opposed lateral sides of the channel and being in frictional contact with the particle-accumulating surface to prevent fluid flow therebetween, means for supplying liquid toner at the mouth of the channel such that the liquid toner has a tendency to flow through the channel in a second direction opposite the first direction, biasing means in communication with the electrode for creating an electric field between the electrode and particle-accumulating surfaces, the electric field compelling the charge-bearing particles of the liquid toner to migrate towards the particle-accumulating surface forming a concentration of particles proximate to the particle-accumulating surface, the concentration of particles adhering to the rotating particle-accumulating surface to provide a particle rich slime moving in the first direction, thereby leaving a substantially particle-free flow of fluid dispersant in the second direction, and means for removing the slime from the particle-accumulating surface at a location remote from the electrode.

17. The system of claim 16 wherein said mouth is positioned at a level above said outlet so that said mouth is in gravity feed relation to said outlet, said outlet being in fluid communication with a fluid dispersant drain line which defines a flow path from said outlet to a trap level above said outlet.

* * * * *